US005885232A

United States Patent [19]

Guitay

[11] Patent Number: 5,885,232

[45] Date of Patent: Mar. 23, 1999

[54] ROLLER MASSAGING APPARATUS WITH SUCTION FUNCTION

[75] Inventor: Louis Paul Guitay, Drome, France

[73] Assignee: LPG Systems, France

[21] Appl. No.: 776,474

[22] Filed: Jan. 17, 1997

[30] Foreign Application Priority Data

Aug. 5, 1994 [FR] France ..... 94.09930

[51] Int. Cl.[6] ..... A61H 1/00

[52] U.S. Cl. ..... 601/6; 601/7; 601/122; 601/123; 601/125

[58] Field of Search ..... 601/6, 7, 8, 9, 601/10, 12, 14, 122, 123, 124, 125, 133, 134, 135

[56] References Cited

U.S. PATENT DOCUMENTS

| | | | |
|---|---|---|---|
| 2,574,601 | 11/1951 | Swanson | 601/7 |
| 4,729,368 | 3/1988 | Guitay | 601/7 |
| 4,883,047 | 11/1989 | Giutay | 601/7 |
| 5,665,053 | 9/1997 | Jacobs | 601/6 |

FOREIGN PATENT DOCUMENTS

| | | | |
|---|---|---|---|
| 0 224 422 | 2/1990 | European Pat. Off. . | |
| 0 284 527 B1 | 9/1991 | European Pat. Off. . | |
| 832959 | 10/1938 | France | 601/6 |
| 2057514 | 5/1971 | France . | |
| 2 579 100 | 3/1985 | France . | |
| 4228406 | 1/1994 | Germany | 601/6 |

*Primary Examiner*—Richard J. Apley
*Assistant Examiner*—Benjamin Koo
*Attorney, Agent, or Firm*—Wall Marjama Bilinski & Burr

[57] ABSTRACT

A massage apparatus including a casing having an open bottom chamber therein. A pair of spaced apart end rollers are rotatably mounted in the chamber so that they ride in sealing contact against two side walls and top wall of the chamber. A suction is applied to the region between the rollers so that a skin fold is created in the chamber between the rollers when the rollers are applied to the skin of a patient.

8 Claims, 3 Drawing Sheets

ROLLER MASSAGING APPARATUS WITH SUCTION FUNCTION

BACKGROUND OF THE INVENTION

The present invention relates to an improved massage apparatus making it possible, in simple and efficient fashion, to perform massages in which an action of suction and mobilization of the skin tissue is exerted on the patient.

In the rest of the description, the invention will be described with reference to an apparatus used for the treatment of human beings, but it is clear that an apparatus of this type could also be used for massaging animals such as horses, cattle, etc.

The invention relates more particularly to an improvement made to the massage apparatuses of the type which formed the subject-matter of patents published under 224 422 and 284 527, the apparatus according to the invention making it possible, at the same time, to obtain the advantages provided by the general design described in these documents, while eliminating the drawbacks which they may present.

In general, the apparatuses described in the aforementioned documents include, mounted inside a casing, two parallel rollers with a smooth surface and mounted free to rotate (or rotationally driven) in the casing, the said casing being connected to means which comprise a conduit whose end opens into the space contained between the rollers and which make it possible to create a reduced pressure in the casing in the space contained between these rollers, when the latter are applied against the patient's body.

In the solution described in FR-A-2 579 100, one of the rollers is positively driven in rotation and the second is combined with means making it possible to move it away from the drive roller. This solution is very complex and is not satisfactory because it involves specific means, such as a mechanical control system consisting of a lever actuated by the user in order to move the free roller away from the drive roller when starting. Furthermore, during the treatment, the separation is obtained by action of the skin fold formed between the rollers.

From the functional point of view, in this equipment the pressure exerted on the skin fold is difficult to control and, above all, it may be too high, and therefore traumatizing. Indeed, this pressure is given both by the suction and also by the action of the return means on the rollers, which tend to move them towards one another.

The solution in which the rollers though which a suction is drawn are mounted with a fixed inter-axial distance is satisfactory in the case of small apparatuses, for example ones with rollers 0.5 to 6 centimetres long, but it has been observed that, in the case of apparatuses in which the roller are longer, the efficiency obtained is less than that attained with the solution in which the rollers can move apart or move towards one another automatically during the massage operation.

SUMMARY OF THE INVENTION

A solution has, however been found, and this forms the subject-matter of the present invention, which makes it possible, at the same time, to move the rollers relative to one another during the massage operation, without it being necessary to provide additional sealing means, such as valves or tilting flaps, as well as to have a movement of the rollers towards one another limited to a determined value during the massage operation, in a manner which is comparable with the solution in which the rollers are mounted on the casing with a fixed inter-axial distance.

Furthermore, the novel apparatus according to the invention is particularly well-suited to being mounted at the exit of a suction circuit including a solenoid valve produced according to the teachings of patent application WO-95/09596, which makes it possible to obtain not only all or nothing operation, but also a controlled flow rate of the air fluid between two predetermined values, with the possibility of adjustment between the said values, making it possible to obtain "sequential, pulsed, rhythmic" operation such that, during the massage operation, the suction rate varies cyclically, causing the rollers to move towards each other and apart, thus causing an effect of "vibration" and of variation of the suction force and of the take-up of the skin, thus improving the efficiency of the treatment and also allowing easier use of the apparatus on the patient.

In general, the massage apparatus according to the invention, which makes it possible to perform massage treatments resorting to an action of suction and mobilization of the skin tissue, is of the type including, mounted inside a casing, two parallel rollers mounted so that they are free to rotate in the casing which is connected to means comprising a conduit whose end opens into the space contained between the rollers which make it possible to create a reduced pressure in the casing, in the space contained between these rollers, when the latter are applied against the patient's body.

According to the invention, the two rollers are mounted between two side walls perpendicular to the axles of the said rollers and to the end wall of the casing, these two walls defining, with the said end wall and the said rollers, a chamber which is open on the face opposite the said end wall and whose height is such that it corresponds substantially to the diameter of the rollers which are mounted on side walls, so that they bear against the latter and are tangent to the said end wall, there being a slight clearance in order to allow them to rotate, while retaining the seal, their diameter being such that they extend slightly beyond the lower edges of the side walls.

A design of this type corresponds substantially to the teachings of European patent 284 527.

In comparison with the teachings of this patent, the device according to the invention is characterized in that the rollers are not mounted with a fixed inter-axial distance between the two side walls, but may undergo a displacement relative to one another by sliding in slots provided in the said walls, while remaining tangent to the end wall of the casing, the two rollers being kept normally separated by the use of thrust means acting on their axles, the movement of the two rollers towards one another under the effect of the suction being limited to a predetermined value.

Although, according to one embodiment, the end wall of the casing may be flat, it could be envisaged to have an end wall which is either slightly concave or slightly convex, the axis along which the rollers slide inside the slots provided in the walls having a radius of curvature identical to that of the end wall, so that the rollers are always tangent to this end wall.

In order to ensure leaktightness in the device according to the invention, it is essential for the exit orifice of the suction conduit to have a cross-section such that, when the two rollers are moved towards one another, its periphery is contained within the space defined between the lines of contact of the two rollers with the end wall of the casing. This orifice may either be located at the same level as the lines of contact of the rollers with the end wall, or set back from these lines.

Furthermore, various types of thrust means may be used for keeping the two rollers normally separated from one another. According to one embodiment according to the invention, these means consist of two springs which bear on a fixed part in the central region of the casing and are arranged in two lateral chambers contiguous to the sliding slots.

The thrust means should be designed in order, on the one hand, to control the pressure on the skin fold when they are brought towards one another under the effect of the suction and, on the other hand, so as not to eject the rollers from the slots when the latter are open at their ends.

In order to allow the rollers to be fitted and removed easily, in one embodiment, the sliding slots are open to the outside, it being possible for the axles of the rollers to be forcibly inserted (snap-fastened) into the said slots.

In one such embodiment, the maximum separation between the two rollers does not exceed the ends of the end-wall of the casing, since a leak would then be produced. This maximum separation may be adjusted, for example by providing retaining bosses on the surface of the slots, thus forming an end-stop which restrains the rollers axle in the extreme position but nevertheless allows the axles of the rollers to be inserted forcibly. Of course, any other way of retaining the rollers in the extreme position could be used.

It is furthermore possible, in one variant according to the invention and by virtue of such a design, to arrange at least one additional roller between the two active rollers, which makes it possible to have the simultaneous formation of two (or more) successive skin folds during the treatment.

Finally, although the active rollers are preferably cylindrical and smooth, it may however be envisaged to have a different surface condition provided, however, that leak-tightness with the walls and the end wall of the casing is ensured.

The invention, and the advantages which it provides, will nevertheless be understood more clearly by virtue of the illustrative embodiment given below, by way of indication but without implying any limitation, which is illustrated by the appended diagrams, in which:

DESCRIPTION OF THE INVENTION

Figure 1:
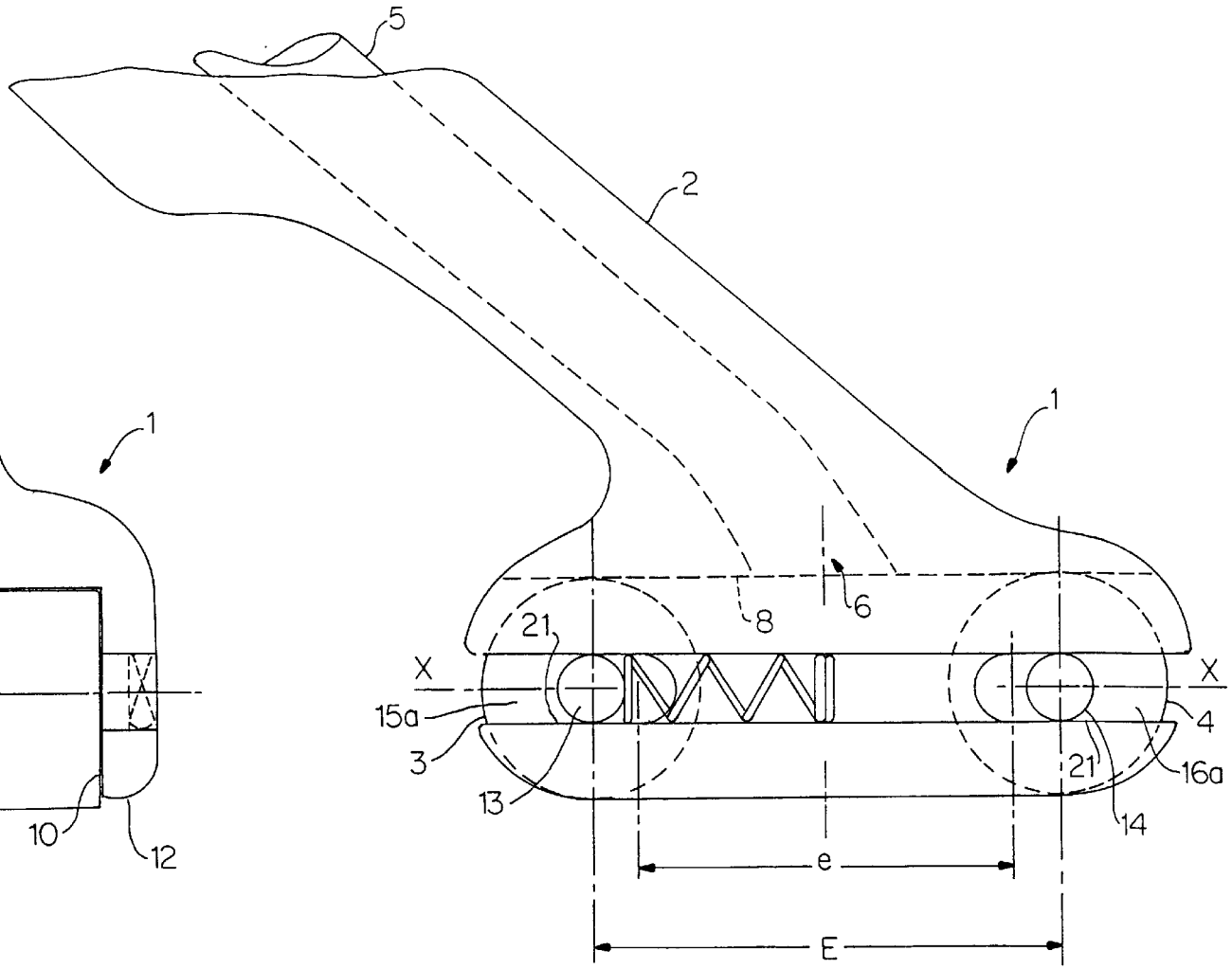
FIGS. 1 and 2 are respectively elevation and end views of a massage apparatus produced according to the invention.

Referring to the appended diagrams, the massage apparatus according to the invention, which makes it possible to perform treatments combining an action of suction and mobilization of the skin fold, includes a casing, denoted by the general reference (1), which can be moved manually using a handle (2). This casing supports two parallel rollers (3, 4) which are mounted so that they are free to rotate. This casing is connected via a conduit (5) to a suction source, the end (6) of the said conduit opening into the space contained between the rollers, and thus making it possible to create a reduced pressure inside the casing in the space contained between the said rollers (3, 4) when the latter are applied against the patient's body, forming a fold on which the action of suction and mobilization of the skin fold is exerted.

Figure 2:
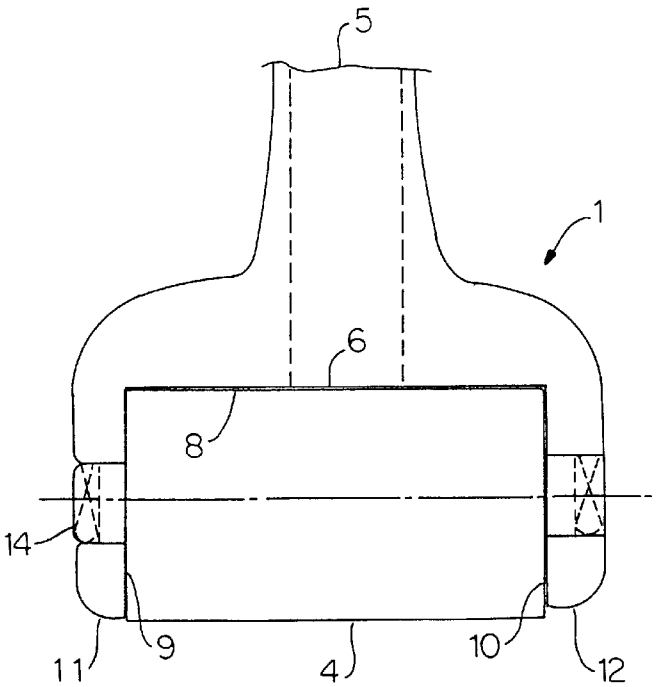
Figure 3:
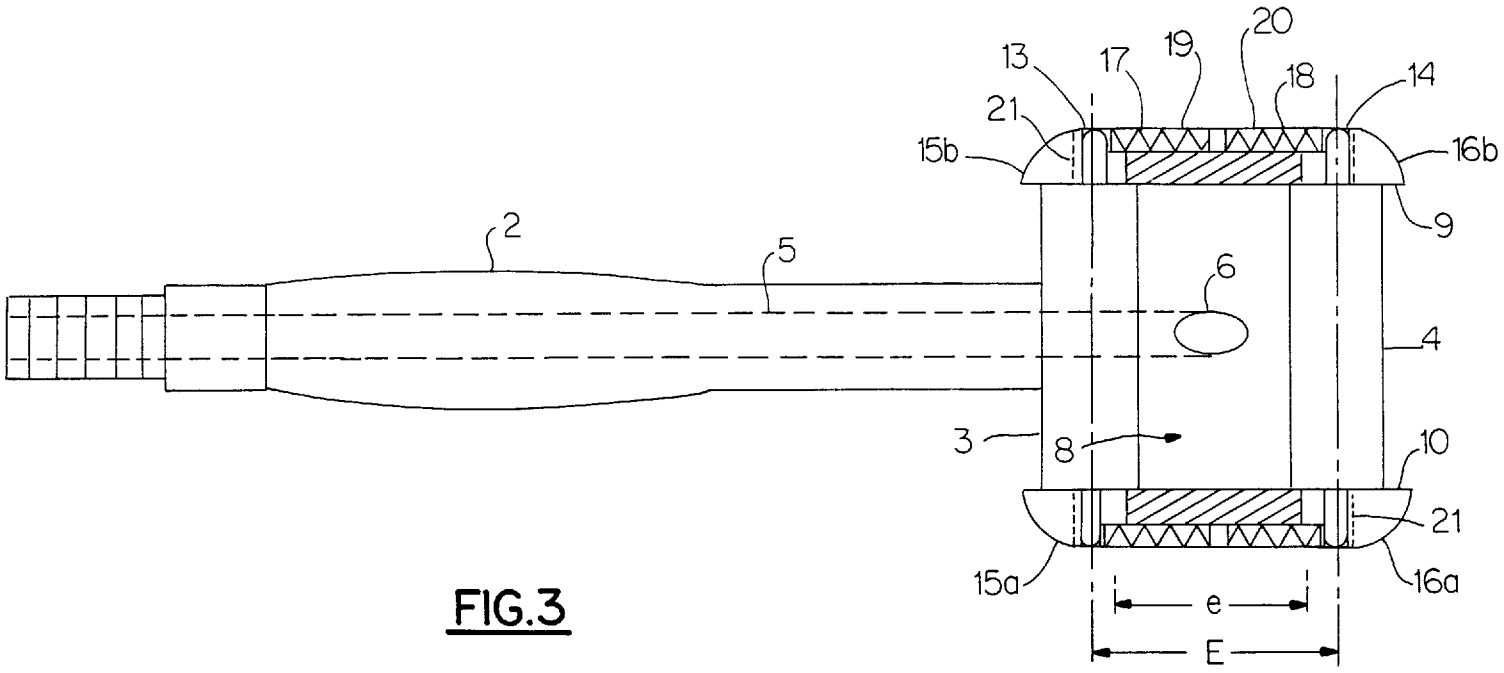
FIG. 3 is a bottom view in section on a plane passing through axis XX in FIG. 1.

As shown by the appended FIGS. 1 to 3, which illustrate one embodiment of an apparatus produced according to the invention, the two active rollers (3, 4) are mounted perpendicularly between the two side walls (9, 10) of the casing, the rollers being tangent to the top wall (8), and laterally with the walls (9, 10), there being a slight clearance in order to allow them to rotate while maintaining the seal.

A chamber which is open on the side opposite the said top wall (8) is thus formed, the height of which is such that it corresponds substantially to the diameter of the rollers (3, 4), which preferably extend slightly beyond the lower edges (11, 12) of the side walls (9, 10).

In this embodiment, the active rollers (3, 4) are mounted inside the casing by using their axles (13, 14), inside two slots **(15*a*, 15*b*–16*a*, 16*b*)** whose shape is such that the rollers are always tangent to the end wall of the casing when they move. These slots may open to the outside of the casing, as illustrated in the appended diagrams. In such a case, the lateral sealing is obtained either solely by the side faces of the rollers, which bear against the inner walls of the casing, or by providing a lateral valve incorporated in the thrust means, which closes off the slots if their length allows a displacement which is longer than the radius of the rollers.

Furthermore, the end (6) of the suction conduit has a cross-section such that, when the two rollers are moved towards one another, the said conduit will be contained in the surface contained between the two lines of tangence of the rollers with the end wall of the casing, thus avoiding any leak.

By virtue of such a design, and above all when an apparatus of this type is connected to a suction source via a solenoid valve, as described in WO-95/09596, the combined action of the suction and the speed of advance of the apparatus against the patient's body provides, when the suction rate varies cyclically, "sequential, pulsed, rhythmic" operation by the rollers moving towards one another or apart, which causes a vibration effect on the taking-up of the skin fold.

Furthermore, this particularly simply designed device can be disassembled with ease, in particular in order to clean it, and the casing/operating handle assembly may be produced by monobloc moulding.

Figure 5:
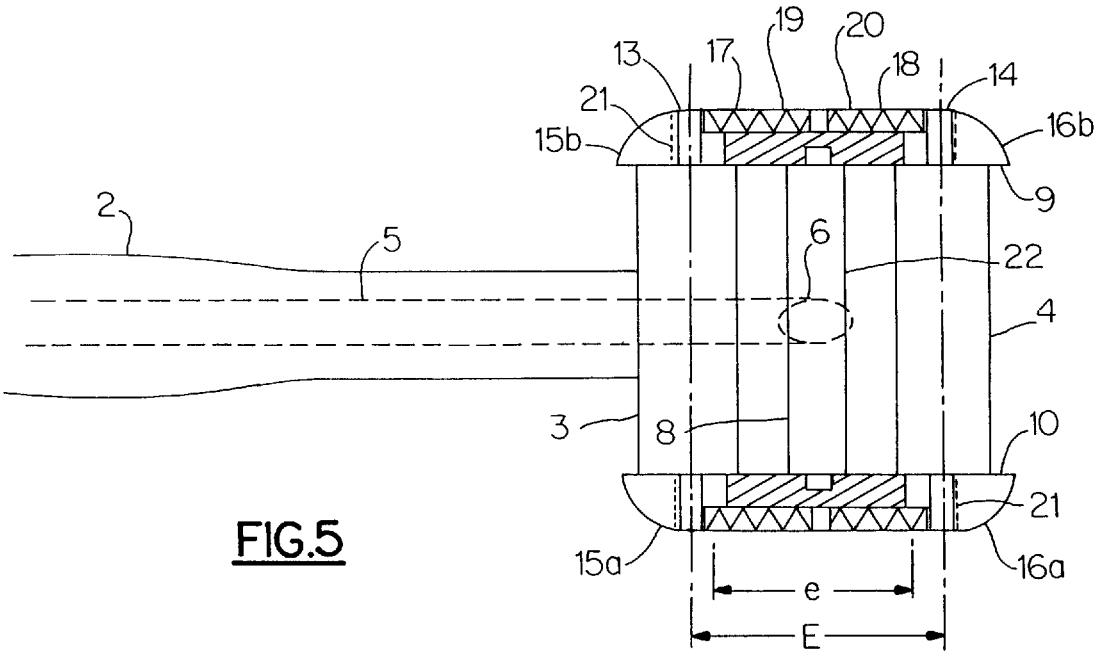
FIGS. 4 and 5 are views in elevation and from below, in section on a plane passing through the axis XX in FIG. 4, of a variant of a massage apparatus produced according to the invention, including an additional roller between the two active rollers.
Figure 4:
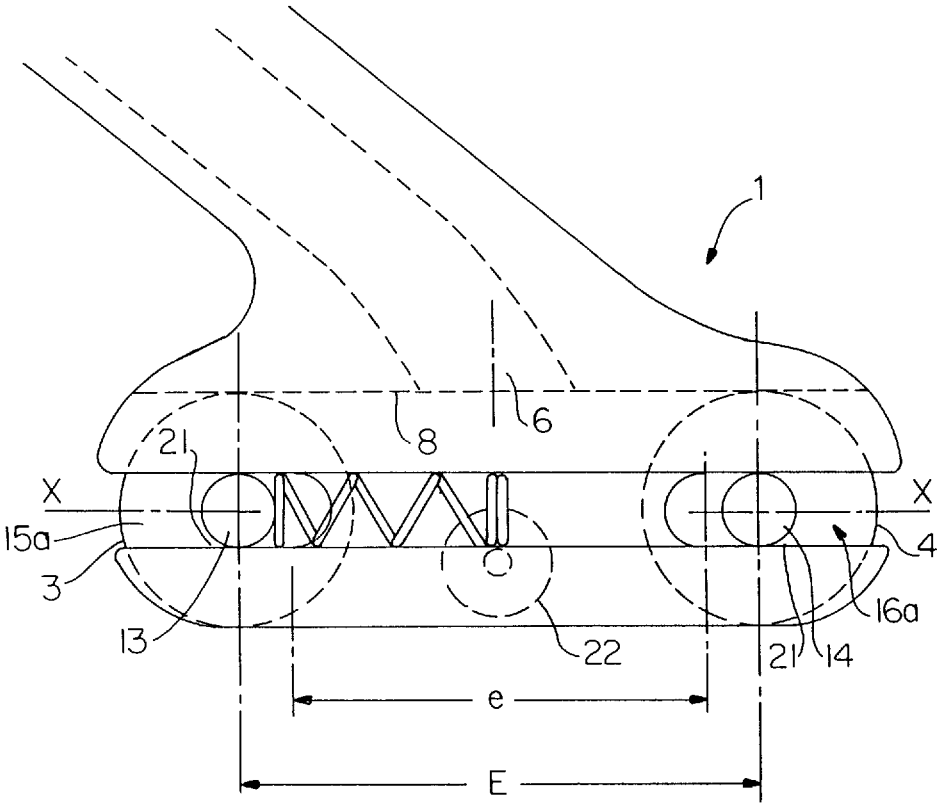

Thus, as can be seen from the appended FIGS. 4 and 5, it may be envisaged to produce an apparatus according to the invention which includes, between the two active rollers (3) and (4), an additional roller (22) mounted so that it is free to rotate on the walls. The position of the intermediate roller (22) within the casing, and its diameter, should be such that they do not interfere with the reduced pressure inside the casing, in the space contained between the active rollers, or with the rollers being moved towards one another.

In the embodiment illustrated, the diameter of the intermediate roller is less than the two active rollers (3) and (4). The periphery of this roller is preferably located in the same plane as the base of the side walls and, unlike the active rollers (3, 4), does not extend beyond them.

A design of this type is particularly well-suited to producing large apparatuses, and in comparison with the solution which only includes two active rollers, it has the advantage of allowing two successive skin folds to be mobilized, thus leading to a further enhanced action or skin manipulation.

I claim:

1. A manually operated massage apparatus comprising a casing containing an open chamber in the bottom section thereof, said chamber having a pair of opposed side walls, and a top wall, said side walls containing parallely aligned slots therein that extend along the chamber, said slots following the contour of the top wall of the chamber whereby the distance between the center lines of each slot and the top wall remains constant along the chamber, a pair of spaced apart roller, each of said roller being longitudinally mounted on shafts that are slidably contained within the slots so that the rollers may freely rotate, each of said rollers being mounted in close uniform proximity with the side walls and the top wall of the chamber at all times, the spacing between the rollers and the walls being such that at least a partial seal can be formed said casing further containing a conduit having an exit orifice that opens into the space between said rollers so that a reduced pressure is created in said space when the rollers are applied to the skin of a patient to produce a skin fold within the space between the rollers, and biasing means acting upon the rollers for urging the rollers apart into a first position and wherein the roller can move toward each other under the effect of suction being drawn in the chamber within the space between the rollers.

2. The apparatus of claim 1 wherein the top wall of the casing is a continuous surface.

3. The apparatus of claims 1 wherein said exit orifice of the suction conduit has a cross section such that when the two rollers are moved toward each other the periphery of the orifice lies inside the lines of contact of the rollers with the top wall of the chamber.

4. The apparatus of claim 1 wherein said biasing means includes a pair of opposed springs that bear upon a fixed member located centrally in the casing.

5. The apparatus of claim 4, wherein the shafts of said rollers are contained in elongated slots formed in said opposing side walls and said opposed springs are seated in lateral recesses contiguous to said slots.

6. The apparatus of claim 1 that further include at least one intermediate roller mounted between the two end rollers whereby at least two skin folds can be created within the chamber during a treatment.

7. The apparatus according to claim 6 wherein the diameter of the intermediate roller is less than the diameter of the end rollers and its periphery is tangent to the bottom surfaces of the opposed side walls.

8. The apparatus of claim 1 that further includes control means for adjusting the amount of suction applied to the casing chamber.

* * * * *

UNITED STATES PATENT AND TRADEMARK OFFICE

CERTIFICATE OF CORRECTION

PATENT NO. : 5,885,232

DATED : March 23, 1999

INVENTOR(S) : Louis Paul Guitay

It is certified that error appears in the above—identified patent and that said Letters Patent is hereby corrected as shown below:

On the title page, after [22] should read --PCT Filed: July 4, 1995--; and insert -- [86] PCT No.: PCT/FR95/00890

371 Date: Jan. 17, 1997

102(e) Date: Jan. 17, 1997

[87] PCT Pub. No.: WO96/03959

PCT Pub. Date: Feb. 15, 1996 --

Signed and Sealed this

Ninth Day of November, 1999

*Attest:*

Q. TODD DICKINSON

*Attesting Officer*

*Acting Commissioner of Patents and Trademarks*